US007296612B2

(12) United States Patent
Bend

(10) Patent No.: US 7,296,612 B2
(45) **Date of Patent: *Nov. 20, 2007**

(54) APPARATUS AND METHOD FOR LOW PRESSURE SAND CASTING

(75) Inventor: Robert J. Bend, Plymouth, MI (US)

(73) Assignee: Equipment Merchants International Inc., Cleveland, OH (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/554,758

(22) Filed: Oct. 31, 2006

(65) Prior Publication Data

US 2007/0062666 A1 Mar. 22, 2007

Related U.S. Application Data

(63) Continuation of application No. 10/546,561, filed on Aug. 24, 2005, now Pat. No. 7,134,479.

(51) Int. Cl.
*B22D 35/04* (2006.01)

(52) U.S. Cl. ..... 164/136; 164/336; 164/360

(58) Field of Classification Search ..... 164/136, 164/336, 359–360, 326
See application file for complete search history.

(56) References Cited

U.S. PATENT DOCUMENTS 5,271,451 A 12/1993 Chandley et al. ..... 164/63
5,704,413 A 1/1998 Takasaki et al. ..... 164/136
6,543,518 B1 4/2003 Bend et al. ..... 164/325

FOREIGN PATENT DOCUMENTS

| | | |
|---|---|---|
| DE | 196 49 014 | 5/1998 |
| EP | 578 922 | 7/1997 |
| GB | 2 187 984 | 9/1987 |
| GB | 2 275 010 | 8/1994 |
| WO | 99/58271 | 11/1999 |
| WO | 00/44516 | 8/2000 |

*Primary Examiner*—Kuang Y. Lin
(74) *Attorney, Agent, or Firm*—Renner, Otto, Boisselle & Sklar

(57) ABSTRACT

A process for counter gravity sand casting including providing precision cores in a sand mould supported in a casting machine for rotation about a horizontal axis through the center of the mould, providing primary casting risers fed by a launder section, a pressure riser connected to the launder section and the primary risers, rising upwardly beside the mould, whereby on rotation the molten metal in the pressure riser will maintain an internal constant pressure in the mould until the casting risers are upper most, so as to maintain the internal pressure during the cooling of the mould.

20 Claims, 3 Drawing Sheets

APPARATUS AND METHOD FOR LOW PRESSURE SAND CASTING

RELATED APPLICATIONS

The present application is a continuation of U.S. patent application Ser. No. 10/546,561 filed Aug. 24, 2005 now U.S. Pat. No. 7,134,479, which was a national phase filing under 35 U.S.C. §371 of International Application No. PCT/AU03/01426 filed Oct. 30, 2003 which claimed priority to Australian Patent Application No. 2002952343. The entire disclosures of these earlier applications are hereby incorporated by reference.

FIELD OF THE INVENTION

The present invention relates to methods of casting light metals and more particularly to the use of a riser that retains pressure on the liquid casting during the sand moulds rotation through 180°. More particularly, the present invention is directed to an improved process and method of casting aluminum with the use of precision sand and counter gravity filling of moulds followed by 180° rotation of the mould to put the risers and feed metal on top of the casting.

BACKGROUND TO THE INVENTION

For purposes of explanation, reference will be made to the use of the present invention with respect to the casting of motor cases (engine blocks). It should be understood by those of ordinary skill in the art that the invention is not limited to use in casting engine blocks and can be used in the casting of other products. Cylinder Blocks have traditionally been manufactured as a casting in Cast Iron. Recently Aluminum alloys have become the material of choice for cylinder blocks. While the weight and thermal conduction rates of aluminum have big advantages over cast iron, the actual casting of liquid aluminum is problematic. Conventional gravity pouring of aluminum alloys results in turbulent flow and the manifestation of oxides dispersed through the casting. These oxides often become the failure points for the casting in service. To overcome this problem with oxide formation, counter gravity filling of the liquid aluminum from the bottom of the mould has become the preferred method of casting. The major problem with counter gravity filling of moulds is the slow production rates, the mould filling system either low pressure or electromagnetic pump need to retain pressure until the casting has solidified, which for a cylinder block can be up to eight minutes. While the counter gravity filling is desirable, the solidification time and subsequent low productivity are not. To overcome this low productivity problem, methods of disconnecting the mould from the filling system and rotating the mould while the casting is still liquid have been developed. Once the mould and casting are rotated through 180° the risers which supply liquid metal during the solidification phase of the cast process are on top of the casting and gravity feed the required liquid metal into the contracting casting.

A major problem has been the differential pressures created in the liquid casting during rotation, which can result in casting imperfections; the present invention shows how to overcome this problem.

BRIEF STATEMENT OF THE INVENTION

Thus there is provided according to the invention a process for counter gravity sand casting including providing precision cores in a sand mould supported in a casting machine for rotation about a horizontal axis through the center of the mould, providing primary casting risers fed by a launder section, a pressure riser connected to the launder section and the primary risers and rising upwardly beside the mould, whereby on rotation the molten metal in the pressure riser will maintain a internal constant pressure in the mould until the casting risers are upper most to maintain the internal pressure during the cooling of the mould.

In a further form, the invention may be said to reside in sand mould for a counter gravity filling casting operation including primary casting risers fed by a launder section, a pressure riser connected to the launder section and the primary risers, rising upwardly beside the mould.

Preferably the mould is connected to a roll over fixture and casting machine via at least one chill, which forms part of the mould.

In a further form, the invention may be said to reside in a process for counter filling a sand casting including primary casting risers fed by a launder section, and a pressure riser connected to the launder section and the primary riser, rising upwardly beside the mould, including the steps of filling the mould using mould filling means, sealing the mould via mould sealing means, and rotating the mould via mould rotation means.

Preferably, the risers are fed by a launder section, and a pressure riser connected to the launder section and the primary riser, rising upwardly beside the mould, including the steps of filling the mould using mould filling means, sealing the mould via mould sealing means, and rotating the mould via mould rotation means.

Preferably, the molten metal is fed into the mould void at its lowermost position.

Preferably, a PLC controlled closed loop feedback is used to control the liquid fill rate to the mould.

Preferably, when the mould filling means has filled the mould, an input from a metal level sensor will direct the mould sealing means to push a sand slide into position so as to disengage the mould from the metal filling system.

Preferably, the rotation means will rotate the mould through 180° while the metal is still liquid, such that the pressure riser maintains a constant positive pressure on the mould during the roll.

DETAILED DESCRIPTION OF THE INVENTION

Figure 1:
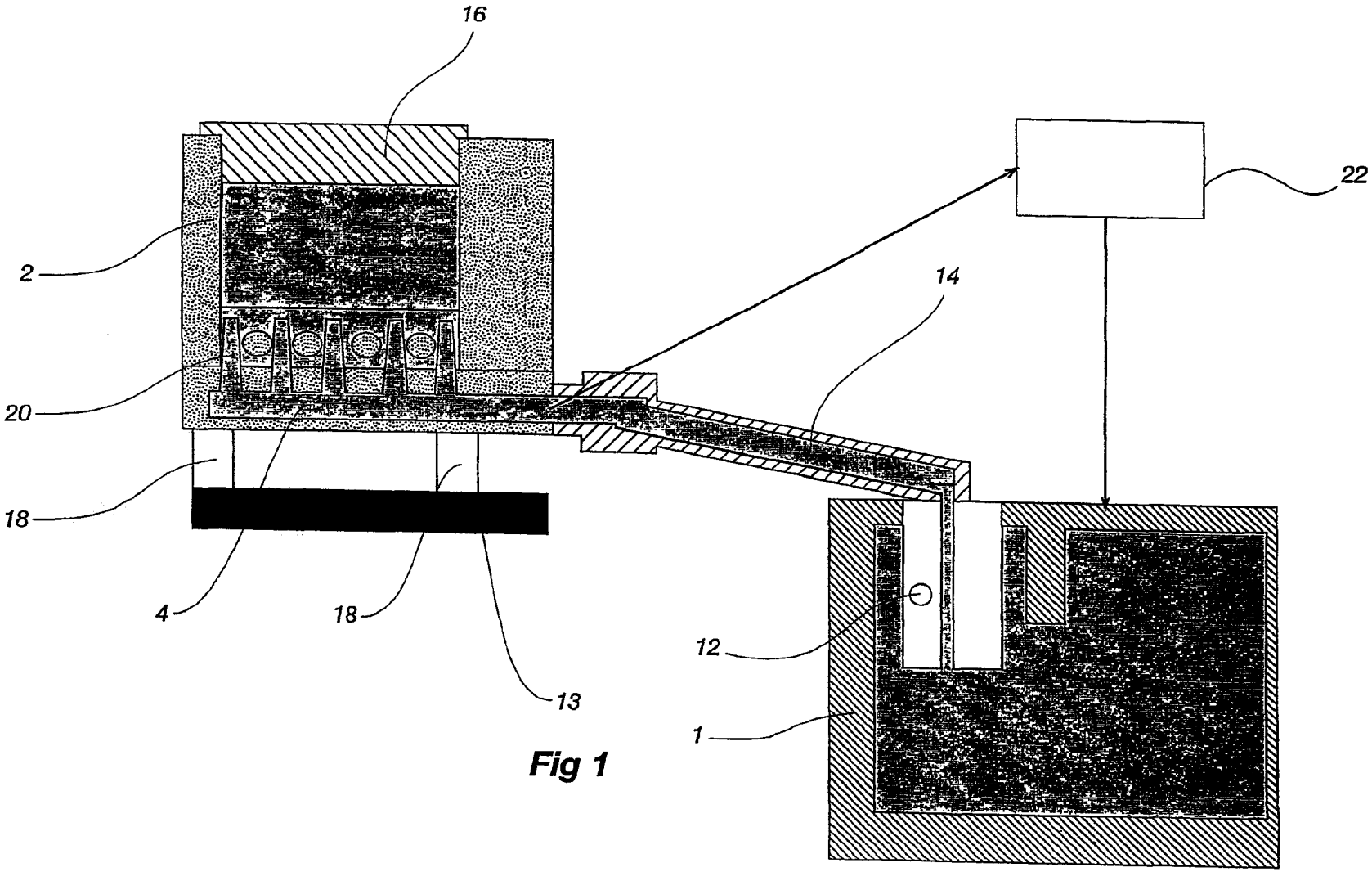
FIG. 1 shows a schematic of the mould on the casting machine during fill.
Figure 2:
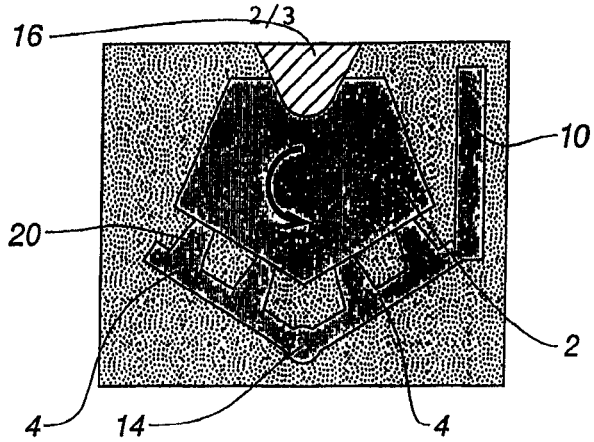
FIGS. 2-6 show the mould and liquid casting in isolation during the roll, the pressure riser position is always in a higher elevation than the casting until the primary risers are on top of the casting at roll complete.
Figure 3:
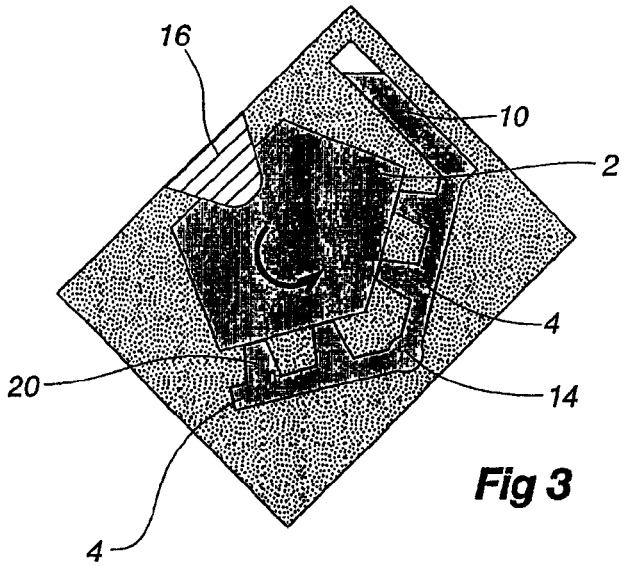
Figure 4:
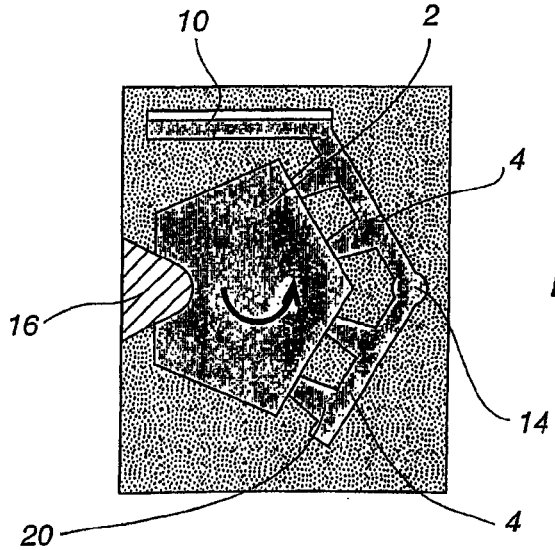
Figure 5:
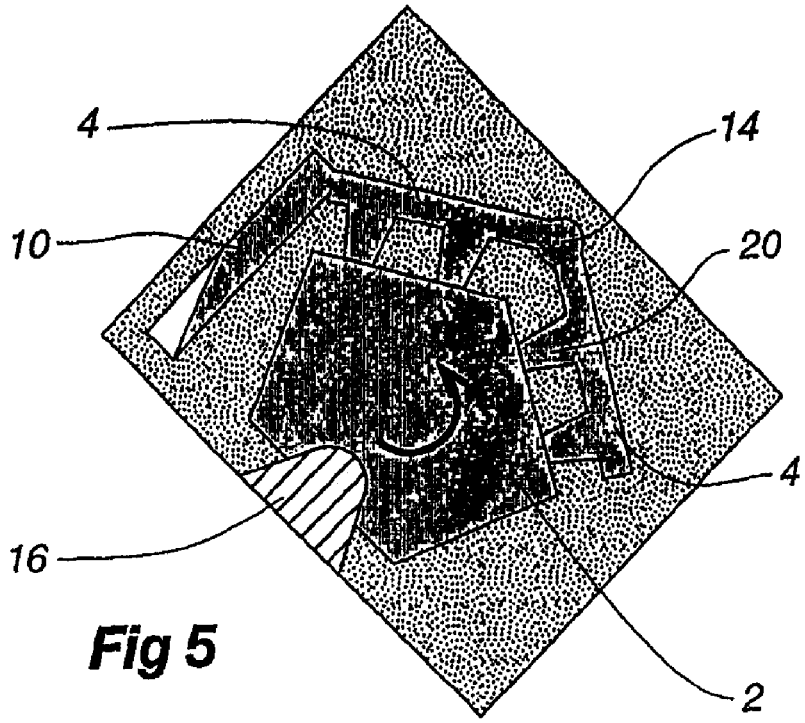
Figure 6:
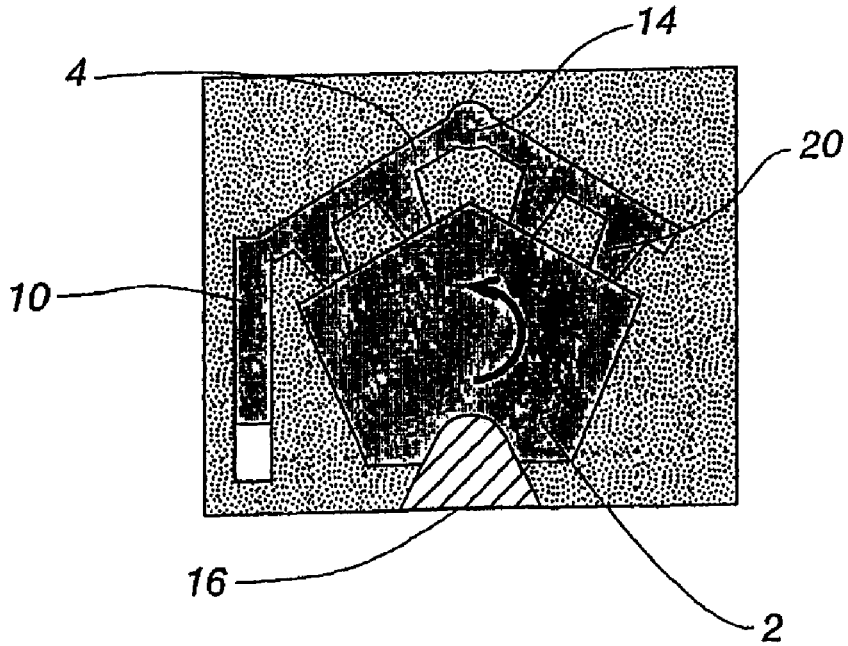

With reference to FIGS. 1-6, there is an apparatus for counter gravity filling a mould 2 including a tower or reverbatory melting furnace, in which the aluminum is melted. From here it is then laundered to a holding furnace 1, from which the liquid metal is pumped either by an electromagnetic or pneumatic pump system 12, to the mould 2 via the metal filling system launder section shown at 14.

With reference to the drawings the mould 2 is supported in the casting machine by the H13 steel chill section 16, for rotation about an axis (not shown) passing through the approximate center of the mould. The chill section is formed into the mould. The primary casting risers 20 extend upwardly into the mould from runners 4 fed from the launder section 14. Also connected to the launder section 14 is a vertical riser 10 extending upwardly outside the mould, the riser in the positions shown in FIG. 1 having a height equal to the height of the mould. In this way during the casting operation the riser is also filled.

The electromagnetic pump 12 pumps the liquid metal into the launder section 14 to fill the mould during the casting operation. This electromagnetic pump 12 is controlled by a PLC 22. Load cells 18 are provided to weigh the liquid filling the mould, the weight of the liquid filled mould being known, the load cells also being connected to the PLC 22, which is implementing fuzzy logic control of the system.

When the mould has been filled (determined using the load cells 18) the PLC 22 controls the closure of a sand slide (not shown) into position that will disconnect the mould 2 from the filling section. As shown in FIGS. 2 to 5 as the mould is then rotated, the pressure riser 10 maintains a constant pressure in the liquid in the mould through the runners 4 and risers 20. When the mould is fully inverted the pressure is maintained by pressure in runners 4 and risers 20.

Hence the casting operation is faster than previous systems and as the molten metal pressure is maintained during the solidification of the metal by virtue of the pressure riser maintaining the pressure during the inversion of the mould, the mould can be removed from the machine and a further mould position for casting.

The total cycle time from load to unload of the mould is estimated to be approximately three minutes. If there are multiple casting machines on a turntable arrangement there is a potential of producing a casting every thirty seconds.

It is considered therefore that the means and processes relating to the mould pressure riser such as that described, herein would prove to be of considerable benefit to those using counter gravity techniques to cast aluminum in particular.

Although the invention has been described in some detail the invention is not to be limited hereto but can include variations and modifications falling within the spirit and scope of the invention.

The invention claimed is:

1. A method of making a metal casting, comprising the steps of:

providing a sand mould having a mould cavity with a shape corresponding to that of the metal casting, a launder section, primary risers connecting the launder section to the mould cavity, and a pressure riser connected to the launder section and the primary risers;

placing the sand mould in a filling position whereat the primary risers extend upwardly to the mould cavity and the pressure riser extends upwardly outside the mould cavity;

engaging the launder section with a liquid metal filing system;

filling the mould cavity with liquid metal while the sand mould is in its filling position, thereby also filling the primary risers and the pressure riser;

sealing the sand mould when the mould cavity has been filled;

disengaging the sand mould from the liquid metal filling system;

rotating the sand mould 180° to its inverted position;

wherein, during the rotating step, the pressure riser maintains a constant pressure in the liquid metal in the mould cavity through the primary risers.

2. A method as set forth in claim 1, wherein the filling, sealing, and rotating step are performed at a filling location.

3. A method as set forth in claim 2, further comprising the step of removing the sand mould from the filling location after said rotating step.

4. A method as set forth in claim 3, wherein the sand mould is loaded at the filling location and wherein the metal casting is unloaded from the sand mould at a solidification location.

5. A method as set forth in claim 4, wherein the cycle time from load to unload is approximately three minutes.

6. A method as set forth in claim 1, wherein said filling step is performed on multiple filling locations positioned in a turntable arrangement.

7. A method as set forth in claim 1, wherein a chill section defines a part of the mould cavity.

8. A method as set forth in claim 7, wherein the chill section defines a top part of the mould cavity when the sand mould is in its filling position.

9. A method as set forth in claim 8, wherein the sand mould further comprises runners extending between the launder section and the primary risers.

10. A method as set forth in claim 1, wherein said sealing step and/or said disengaging step is performed by a sand slide that closes to disengage the liquid metal filling system.

11. A method as set forth in claim 1, wherein the pressure riser has a height equal to the height of the mould cavity when the sand mould is in its filling position.

12. A method as set forth in claim 1, wherein the liquid metal filling system comprises a holding furnace for the liquid metal and wherein said filing step comprises pumping the liquid metal from the holding furnace to the launder section of the sand mould.

13. A method as set forth in claim 12, wherein a PLC controlled closed loop feedback of metal liquid fill rate is used to control said pumping step and/or said sealing step.

14. A method as set forth in claim 1, wherein said rotating step is performed by a roll over fixture which rotates the sand mould through 180° from the filling position to the inverted position.

15. A method as set forth in claim 14, wherein the sand mould is connected to the roll over fixture via a chill section.

16. A method as set forth in claim 15, wherein the chill section defines a part of the mould cavity.

17. A method as set forth in claim 16, wherein the chill section defines a top part of the mould cavity when the sand mould is in its filling position.

18. A method as set forth in claim 1, wherein the shape of the sand mould corresponds to a motor case.

19. A method as set forth in claim 18, wherein the liquid metal comprises aluminum.

20. A method as set forth in claim 1, wherein the liquid metal comprises aluminum.

* * * * *